US009609437B2

(12) United States Patent
Rousseau

(10) Patent No.: US 9,609,437 B2
(45) Date of Patent: Mar. 28, 2017

(54) DIAPHRAGMS FOR LOUDSPEAKER DRIVE UNITS

(71) Applicant: B&W GROUP LTD, Worthing (GB)

(72) Inventor: Martial Andre Robert Rousseau, Brighton (GB)

(73) Assignee: B & W GROUP LTD, Worthing (GB)

( * ) Notice: Subject to any disclaimer, the term of this patent is extended or adjusted under 35 U.S.C. 154(b) by 0 days.

(21) Appl. No.: 14/428,174

(22) PCT Filed: Jul. 31, 2013

(86) PCT No.: PCT/GB2013/052040
§ 371 (c)(1),
(2) Date: Mar. 13, 2015

(87) PCT Pub. No.: WO2014/045008
PCT Pub. Date: Mar. 27, 2014

(65) Prior Publication Data

US 2015/0256938 A1 Sep. 10, 2015

(30) Foreign Application Priority Data

Sep. 18, 2012 (GB) ..... 1216623.7

(51) Int. Cl.
*H04R 1/00* (2006.01)
*H04R 7/12* (2006.01)
(Continued)

(52) U.S. Cl.
CPC ..... *H04R 7/127* (2013.01); *G10K 13/00* (2013.01); *H04R 1/00* (2013.01); *H04R 1/08* (2013.01);
(Continued)

(58) Field of Classification Search
USPC ..... 381/430, 423, 176
See application file for complete search history.

(56) References Cited

U.S. PATENT DOCUMENTS 4,531,608 A 7/1985 Heinz
4,532,383 A 7/1985 Willy
(Continued)

FOREIGN PATENT DOCUMENTS

GB 2 078 464 A 1/1982
GB 2 413 234 A 10/2005
(Continued)

OTHER PUBLICATIONS

International Search Report (Form PCT/ISA/210) issued on Aug. 7, 2014, by the European Patent Office in corresponds to the International Application No. PCT/GB2013/052040.(4 pages).
(Continued)

*Primary Examiner* — Sunita Joshi
(74) *Attorney, Agent, or Firm* — Buchanan Ingersoll & Rooney PC

(57) ABSTRACT

A diaphragm for a loudspeaker drive unit or for a microphone includes a rigid dome-shaped member having a thickness that varies from a first thicker thickness at a first location at the periphery of the dome-shaped member to a second thinner thickness at a second location, which is nearer to the center of the dome-shaped member. There is a step-wise change in thickness at a location between the first location and the second location. Having greater thickness at the periphery of the dome-shaped member may improve stiffness of the diaphragm and may allow for an increased break-up frequency. Having thinner material elsewhere in the dome-shaped member may allow the mass of the diaphragm to be kept low and may result in better acoustic sensitivity.

12 Claims, 4 Drawing Sheets

(51) Int. Cl.

| | |
|---|---|
| ***G10K 13/00*** | (2006.01) |
| ***H04R 31/00*** | (2006.01) |
| ***H04R 1/08*** | (2006.01) |
| *H04R 7/00* | (2006.01) |

(52) U.S. Cl.
CPC ..... *H04R 7/122* (2013.01); *H04R 31/003* (2013.01); *H04R 2207/021* (2013.01); *H04R 2307/027* (2013.01)

(56) References Cited

U.S. PATENT DOCUMENTS

| | | | | |
|---|---|---|---|---|
| 7,274,798 | B2 | 9/2007 | Ohashi et al. | |
| 8,630,440 | B2 | 1/2014 | Dickie | |
| 2006/0072777 | A1* | 4/2006 | Ohashi | H04R 7/18 381/430 |
| 2006/0088184 | A1* | 4/2006 | Ohashi | H04R 7/16 381/430 |
| 2007/0195986 | A1* | 8/2007 | Geaves | H04R 7/127 381/430 |

FOREIGN PATENT DOCUMENTS

| | | | | |
|---|---|---|---|---|
| GB | 2 429 367 | A | 2/2007 | |
| JP | 2005-026920 | A | 1/2005 | |
| JP | 2008-085842 | A | 4/2008 | |
| JP | 2009-232387 | A | 10/2009 | |
| JP | WO 2011024398 | A1 * | 3/2011 | H04R 7/20 |
| KR | 10-2009-0093167 | A | 9/2009 | |
| WO | 2009/107938 | A2 | 9/2009 | |

OTHER PUBLICATIONS

Search Report issued on Dec. 5, 2012, by the United Kingdom Intellectual Property Office in corresponding United Kingdom Patent Application No. 12166231.(4 pages).

E.A.R Speciality Composites White paper concerning "Constrained-layer systems provide weight-efficient, high-level damping" Mar. 21, 2006, http://www.earsc.com/HOME/engineering/TechnicalWhitePapers/Contrain/index.asp?SID=60.(3 pages).

* cited by examiner

DIAPHRAGMS FOR LOUDSPEAKER DRIVE UNITS

This invention relates to diaphragms for loudspeaker drive units or microphones. The problems addressed by the invention will be discussed in terms of loudspeaker drive units although similar problems occur in microphones.

The invention relates in particular, but not necessarily exclusively, to high-frequency loudspeaker drive units, commonly called "tweeters". It is desirable for tweeters to have both a high break-up frequency and high sensitivity. To keep the break-up frequency high, the diaphragm of a tweeter should have a very high stiffness to mass ratio, and, to make the tweeter sensitive, the diaphragm should be light. For these reasons, the use of various special materials has been proposed for tweeter diaphragms, as has the use of various geometries.

GB 2 413 234 discloses a tweeter diaphragm comprising a dome-shaped member of synthetic diamond, and an integrally-formed, peripheral skirt. The provision of the integrally-formed skirt improves the break-up frequency characteristics of the diaphragm. GB 2 413 234 also discloses the general concept of the domed part of the diaphragm having a greater thickness at its periphery than at its centre with the aim of further improving the break-up frequency characteristics of the diaphragm.

U.S. Pat. No. 4,532,383 also discloses the concept of a variable thickness diaphragm, but U.S. Pat. No. '383 proposes a large diaphragm that performs the combined functions of a tweeter and a woofer, the tweeter function being provided by means of a peripheral zone of the diaphragm which is thinner than the central zone that provides the woofer function.

The present invention seeks to provide an improved diaphragm, and in particular, but not exclusively an improved diaphragm for a tweeter unit for a loudspeaker. Such a diaphragm should preferably have good or improved break-up frequency characteristics, yet preferably not by means of expensive or difficult manufacturing techniques. Alternatively or additionally, the present invention seeks to provide an improved method of manufacture of a diaphragm.

SUMMARY OF THE INVENTION

The present invention provides, according to a first aspect, a diaphragm for a loudspeaker drive unit or for a microphone, the diaphragm comprising a dome-shaped member having a thickness that varies from a first thickness at a first location at the periphery of the dome-shaped member to a second thickness at a second location, which is nearer to the centre of the dome-shaped member than the first location. In accordance with this first aspect of the invention, the first thickness is thicker than the second thickness, there being a step-wise change in thickness at a location between the first location and the second location.

Having greater thickness at the periphery of the dome-shaped member improves stiffness of the diaphragm and allows for an increased break-up frequency. Having thinner material elsewhere in the dome-shaped member, for example nearer to the centre of the dome-shaped member, allows the mass of the diaphragm to be kept low despite increased mass at the periphery of the dome-shaped member. Keeping the mass relatively low provides for good acoustic sensitivity. Balancing the conflicting requirements of low mass and high stiffness by means of a step-wise change in thickness in the dome-shaped member provides an elegant solution that is easy to manufacture. The provision of a step-wise change in thickness has not, perhaps surprisingly, introduced any significant resonances that affect the acoustic performance adversely across the audible range of frequencies. Loudspeaker drive units incorporating a diaphragm according to the present invention need not have any further reinforcing means, such as for example carbon rings that are typical in certain speaker designs of the prior art, in order to provide the requisite stiffness at the periphery of the dome-shaped member.

The shape of the dome-shaped member is preferably such that the forward-facing sound-producing surface is generally convex. The shape of the dome-shaped member is preferably such that the forward-facing sound-producing surface does not have any step-wise changes in shape. The shape of the dome-shaped member is preferably such that the rearward-facing surface of the dome-shaped member includes step-wise changes in shape which correspond to the step-wise change in thickness between the first and second locations.

The second location may be at the centre of the diaphragm. The portion(s) of material of the first thickness may represent the thickest portion(s) of the dome-shaped member. The portion(s) of material of the second thickness may represent the thinnest portion(s) of the dome-shaped member.

The dome-shaped member is preferably a rigid member. Preferably the dome-shaped member is substantially solid.

The step-wise change in thickness may represent a change of more than 20% (preferably in the sense that the thinner thickness is less than 80% of the thicker thickness), preferably a change of more than 30%, and yet more preferably more than 40%. For example, the first thickness may be more than twice the second thickness (i.e. the thinner thickness may be less than 50% of the thicker thickness).

The step-wise change in thickness may be such that there is only a negligible region across which the step-wise change in thickness occurs. The step-wise change in thickness, when viewed in cross-section across the centre of the diaphragm, may be localised within a distance of 1% of the width (or diameter) of the diaphragm. Such an abrupt change in thickness allows for ease of manufacture, and perhaps surprisingly does not adversely affect the acoustic response of the diaphragm when installed in a loudspeaker drive unit. A gradient in change of thickness of 1:1 (i.e. the thickness may change by an amount of about 30 μm across a distance of about 30 μm) may be considered as representing a step-wise change. A shallower gradient in change of thickness may still represent a step-wise change, when considered in the context of the size of the diaphragm.

The step-wise change in thickness, when viewed in cross-section across the centre of the diaphragm, may be centred at a location which is between 5% and 25% of the distance as measured from the periphery of the dome-shaped member along the external surface of the dome-shaped member to the centre. It will be appreciated that the diaphragm will typically have a shape that is symmetrical and that therefore for a given cross-section across the centre of the diaphragm, there will be a first step-wise change in thickness centred at a location which is between 5% and 25% of the distance as measured from the periphery of the dome-shaped member along the external surface of the dome-shaped member to the centre and a second step-wise change in thickness centred at a location which is between 75% and 95% of the distance as measured from centre of the dome-shaped member to the periphery of the dome-shaped member. The symmetry of the diaphragm may make the above criteria true for any transverse cross-section taken across the centre of the diaphragm. In the case where the dome-shaped member has a diameter and the step-wise change also has a diameter, it is preferred that the diameter of the step-wise change is between 85% and 95% of the diameter of the dome-shaped member, and more preferably between 88% and 92% of the diameter of the dome-shaped member. It has been found that designing a shape of dome-shaped member where the aforementioned value is in the range of between about 88% and about 92%, inclusive, provides the ideal balance between mass and stiffness; this is particularly the case when the first thickness is more than twice the thickness of the second thickness. An especially preferred embodiment has a first thickness in the range of 60 to 100 μm, a second thickness in the range of 20 to 40 μm, a diameter of the dome-shaped member of between 10 mm and 50 mm, and a diameter of the step-wise change of between 89.0% and 91.0% (more preferably about 90%) of the diameter of the dome-shaped member.

The step-wise change in thickness may be such that the dome-shaped member has a first portion of material defining those regions of the first thickness, the first portion having a shape of a truncated dome-shaped member. The dome-shaped member may have a second portion of material defining those regions of the second thickness, the second portion itself also having the shape of a dome, albeit smaller in size than the dome-shaped member.

The maximum thickness of the dome-shaped member may be less than 0.1 mm. The maximum thickness may be the thickness at the first location. The maximum thickness of the dome-shaped member may be more than 50 μm and is preferably more than 60 μm. The minimum thickness may be less than 50 μm, and is preferably less than 40 μm.

The diaphragm is preferably sized so as to be suitable for use in a tweeter loudspeaker drive unit. The diaphragm diameter may be between 10 mm and 50 mm. The diaphragm diameter is more preferably between 18 mm and 34 mmm, inclusive. The diaphragm diameter may be substantially equal to the diameter of the dome-shaped member.

The diaphragm may be substantially circular in front elevation. It is also possible to apply the invention to an elliptical diaphragm. The diaphragm need not have a curved elliptical or circular shape when viewed from the front, although such shapes are preferred.

The outer sound-emitting surface of the dome-shaped member may have a substantially constant radius of curvature. Such a configuration may simplify manufacture. Better acoustic response characteristics may however be achievable by means of a radius of curvature that increases towards the centre of the dome-shaped member. In particular, good results can be achieved when the radius of curvature of the dome-shaped member at its periphery is less than half the radius of curvature at the centre of the dome-shaped member.

There may be more than one step change in thickness in the dome-shaped member. It may be that at least 90%, by area, of the thickness of the dome-shaped member has a thickness that is substantially the same as one of five fixed thicknesses. The dome shaped member may have five or fewer regions of a constant thickness, separated from other regions by a step-wise change in thickness. The dome shaped member may have three or fewer regions of a constant thickness, separated from other regions by a step-wise change in thickness. It may be that there are only one or two step-wise changes in thickness and that there are only two or three values of thickness for substantially all of the sound-emitting area of the dome-shaped member. It may be that there is a single step-wise change in thickness between two substantially constant thicknesses. It may be that the thickness of the dome-shaped member does not increase substantially from the periphery to the centre of the dome-shaped member. It may be that each region of a given thickness represents the only portion of the dome-shaped member having that thickness.

In certain embodiments it may be desirable for the dome-shaped member to be relatively easy to manufacture. In such embodiments it is preferred if there are not too many changes in thickness in the dome-shaped member. For example it may be that there is only one step-wise change in thickness or optionally only two step-wise changes in thickness. In other embodiments it may be preferable to have a plurality of step-wise changes in thickness in order to enhance the acoustic characteristics of the domed shaped member. Thus, it may be that there are more than two step-wise changes in thickness. For example there may be three, four or five step-wise changes in thickness.

Preferably, the dome shaped member has a mass of less than 200 mg, preferably less than 100 mg.

The dome shaped member may comprise first and second parts joined together. The boundary of one of the first and second parts may, at least partly, define the step-wise change in thickness. The first part may be ring-shaped. The second part may be dome-shaped. The dome shaped member may comprise a first part in the shape of a truncated dome-shaped member. The dome shaped member may comprise a second, dome-shaped, part, the first and second parts being attached to each other such that the step-wise change in thickness is defined in the region of the innermost boundary of the first part.

The first and second parts may be made from different materials, for example a stiffer and more expensive material being used for the first part. The first and second parts may however be made from the same type of material. The materials used may include any of the following aluminium, magnesium, titanium, beryllium, alloys including any of the aforementioned metals as the primary base metal, a composite material, and any of the afore-mentioned materials coated with synthetic diamond.

The diaphragm may be made from two or more pieces (for example comprising the first and second parts mentioned above) joined by means of an adhesive layer, preferably an adhesive that improves the mechanical damping performance of the diaphragm at a given frequency. An adhesive with a mechanical loss factor at the first break-up frequency (at operational temperature) of at least 0.5 may be particularly suitable. Preferably, the mechanical loss factor at the first break-up frequency (at operational temperature) of the adhesive is greater than or equal to 0.6. The adhesive layer preferably has a thickness of at least 10 μm. A thicker layer of adhesive may provide enhanced damping performance, and therefore a thickness of 20 μm or more is preferred. A highly damped adhesive is preferred. Vinyl polymer based adhesives may be suitable for this purpose.

Whilst a two-piece construction is mentioned above, the dome shaped member can alternatively be made so as to have a one-piece construction. Multi-piece constructions are also within the scope of the present invention.

It may be that the dome shaped member is constructed from at least three parts. The dome shaped member may comprise at least two ring-shaped parts and a dome-shaped part. The at least two ring-shaped parts may each be in the shape of a truncated dome-shaped member. One of the at least two ring-shaped parts may have a smaller outer diameter than the other ring-shaped part. The boundary of each ring-shaped part may, at least partly, define a step-wise change in thickness. A step-wise change in thickness may be defined in the region of the innermost boundary of each ring-shaped part.

For example, the dome shaped member may comprise first, second and third parts joined together. The boundary of one of the first and second parts may, at least partly, define a first step-wise change in thickness. The boundary of one of the second and third parts may, at least partly, define a second step-wise change in thickness. The first part may be ring-shaped. The second part may be ring-shaped. The third part may be dome-shaped. The dome shaped member may comprise a first part in the shape of a truncated dome-shaped member. The dome shaped member may comprise a second part in the shape of a truncated dome-shaped member. The dome shaped member may comprise a third, dome-shaped, part, the first, second and third parts being attached to each other such that the first step-wise change in thickness is defined in the region of the innermost boundary of the first part and the second step-wise change in thickness is defined in the region of the innermost boundary of the second part.

The diaphragm may include an integrally-formed, peripheral skirt, which extends from the periphery of the dome-shaped member away therefrom in the axial direction.

There is also provided a method of manufacturing a diaphragm for a loudspeaker drive unit or for a microphone. The method is preferably one which results in the manufacture of a diaphragm according to the first aspect of the present invention. The diaphragm may comprise a dome-shaped member.

According to a second aspect of the invention, the method may comprise a step of providing a first part in the shape of a truncated dome-shaped member. The method may comprise a step of providing a second, dome-shaped, part. The method may comprise a step of forming the diaphragm by attaching first and second parts to each other to form a dome-shaped member having a peripheral region of significantly greater thickness than a central region. The step of attaching the first and second parts may be effected simply by gluing the parts together with a suitable adhesive. The adhesive may have mechanical damping properties as described above.

The method may comprise a step of providing a third part in the shape of a truncated dome shaped member. The method may comprise a step of forming the diaphragm by attaching first, second and third parts to each other to form a dome-shaped member having an intermediate region of significantly great thickness than a central region and a peripheral region of significantly greater thickness than the intermediate region. The step of attaching the first, second and third parts may be effected simply by gluing the parts together with a suitable adhesive. The adhesive may have mechanical damping properties as described above.

The method may comprise a step of providing further parts in the shape of a truncated dome shaped member. The method may comprise the step of forming the diaphragm by attaching the first, second, third and further parts to each other to form a domed shaped member having a plurality of regions of differing thicknesses. The thickness of a given region may be significantly greater than the thickness of an adjacent region located closer to the centre of the dome shaped member. The region of greatest thickness may be located at the periphery of the diaphragm. The attaching of the parts may be effected simply by gluing the parts together with a suitable adhesive. The adhesive may have mechanical damping properties as described above.

According to a third aspect of the invention, the method may comprise a step of making a dome-shaped member of one-piece construction. The method may include etching material away from one or more regions of a sheet of solid material so as to form a first peripheral region and a second central region part, the peripheral region having a significantly greater thickness than a central region. The step of etching may be performed on a substantially flat piece of sheet material. The method may include a step of forming the dome-shaped member from a flat piece of material, for example by using a suitably shaped forming member. A punch and die may for example be used. The etching step could of course be performed after the forming step, but it is preferred that the etching be conducted beforehand.

The present invention also provides, according to a fourth aspect, a loudspeaker drive unit or a microphone including a diaphragm according to the first aspect of the invention or a diaphragm either as manufactured by a method according to the second aspect of the invention or including a dome-shaped member as manufactured by a method according to the third aspect of the invention.

According to a fifth aspect of the present invention, there is provided a loudspeaker drive unit comprising a diaphragm according to the first aspect of the invention or a diaphragm either as manufactured by a method according to the second aspect of the invention or including a diaphragm defined at least in part by a dome-shaped member as manufactured by a method according to the third aspect of the invention. The loudspeaker drive unit may comprise a mounting, for supporting the diaphragm, the diaphragm being mounted for movement relative to the mounting. There may be a voice coil and magnet assembly arranged to cause movement of the diaphragm in response to an electronic signal. There may be a voice coil former associated with the voice coil.

The present invention further provides, according to a sixth aspect, a loudspeaker enclosure including a loudspeaker drive unit according to the fifth aspect of the present invention.

The first break-up frequency of the diaphragm, when forming part of a loudspeaker drive unit or microphone, may be greater than 30 kHz. Preferably the first break-up frequency is about 35 kHz or more. In certain embodiments, the first break-up frequency may be higher than 40 kHz.

It will of course be appreciated that features described in relation to one aspect of the present invention may be incorporated into other aspects of the present invention. For example, the method of manufacture of the invention may result in a diaphragm incorporating any of the features described with reference to the apparatus of the invention and vice versa.

DESCRIPTION OF THE DRAWINGS

Embodiments of the present invention will now be described by way of example only with reference to the accompanying schematic drawings of which.

DETAILED DESCRIPTION

Figure 1:
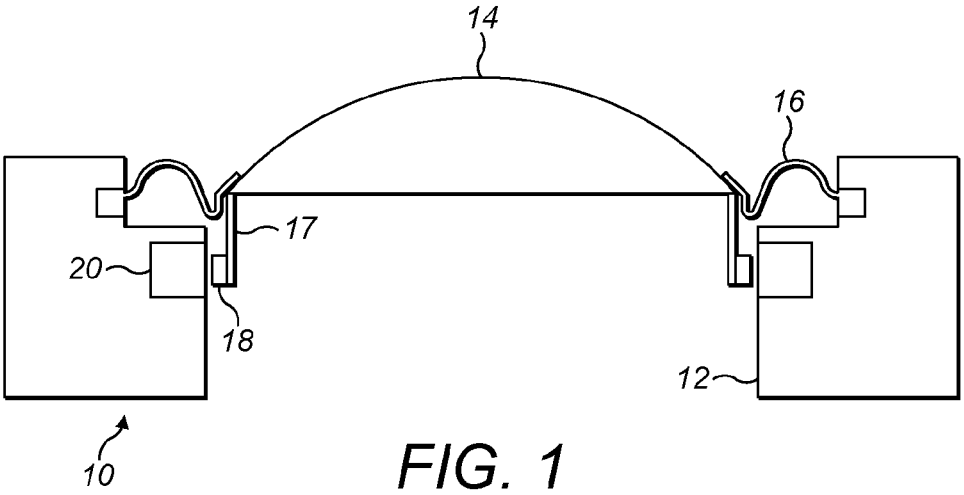
FIG. 1 is a cross-section through a loudspeaker drive unit including a diaphragm in accordance with a first embodiment of the invention mounted in an enclosure of known form.

FIG. 1 shows schematically part of a tweeter loudspeaker drive unit 10 for mounting in an enclosure (not shown). The loudspeaker drive unit 10 may have its rear connected to a rearwardly-projecting sound absorbing tube system (not shown). A grill (not shown) may also be provided at the front of the enclosure.

The loudspeaker drive unit 10 comprises a mounting block 12, a dome-shaped diaphragm 14, and a flexible surround 16 connecting the diaphragm to the mounting 12. A voice coil former 17, on which a voice coil 18 is mounted, is attached to the diaphragm 14 (as shown schematically in FIG. 1). A magnet assembly 20 surrounds the voice coil 18. The general configuration and mounting of the parts that form the tweeter loudspeaker drive unit are known and will not be described further.

Figure 2:
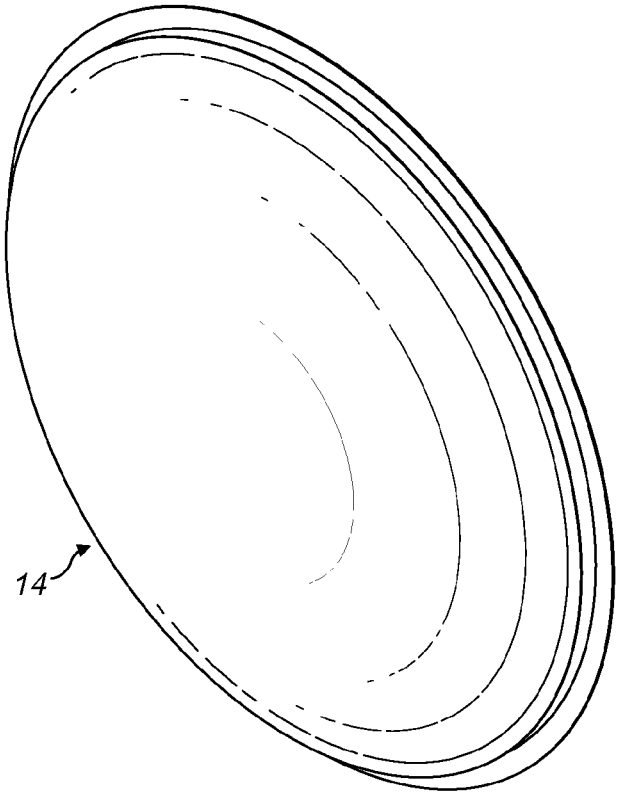
FIG. 2 is a perspective view of the diaphragm of FIG. 1.
Figure 3:
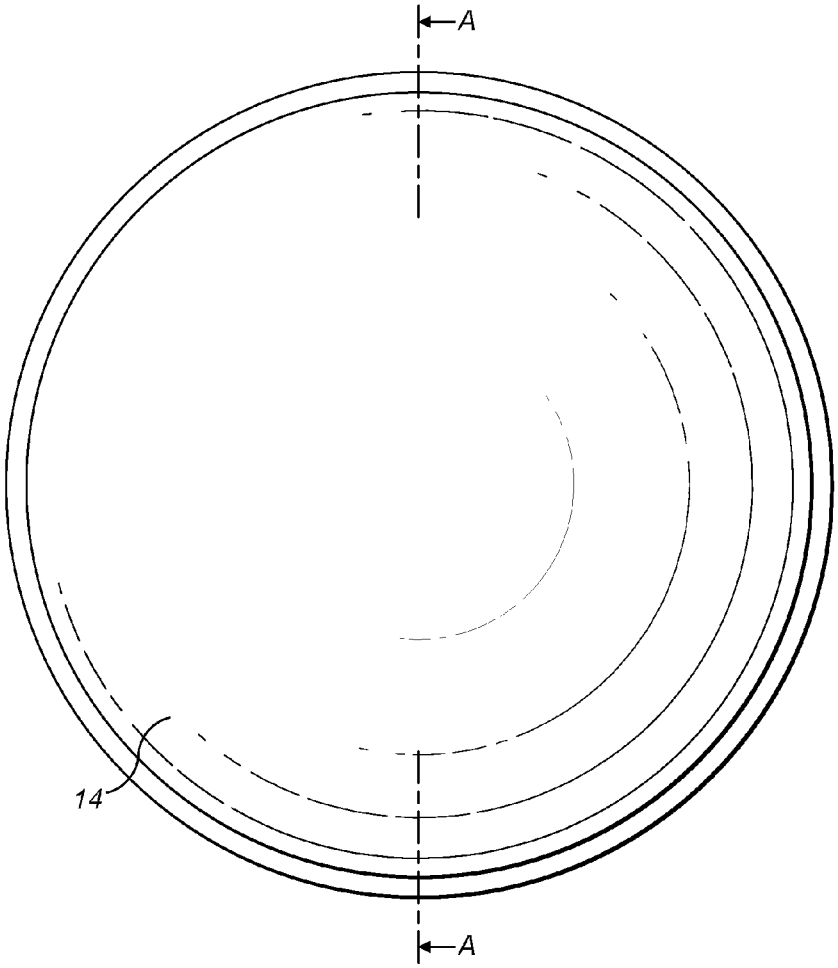
FIG. 3 is a front elevation view of the diaphragm of the first embodiment of the invention.
Figure 4:
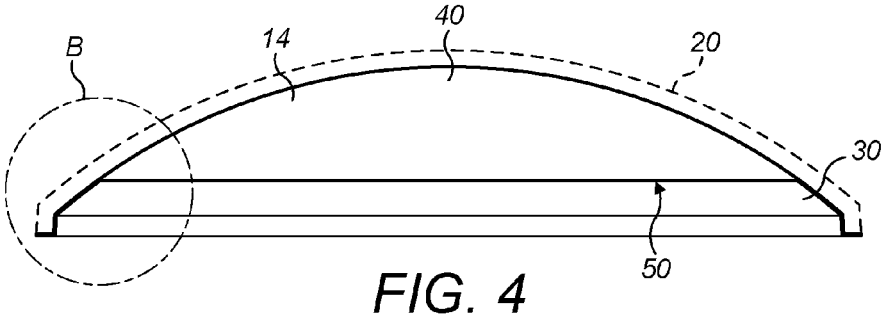
FIG. 4 is a sectional view of the diaphragm of the first embodiment of the invention.

The present invention concerns the dome-shaped diaphragm 14. A dome-shaped diaphragm 14 according to a first embodiment of the present invention is shown in perspective in FIG. 2. FIG. 3 shows a front elevation of the same dome-shaped diaphragm 14. FIG. 4 shows the diaphragm 14 in cross-section, taken about the section A-A.

The diaphragm 14 has two distinct regions: a first, peripheral ring-shaped, region 30 (in the shape of a truncated dome) having a first substantially constant thickness of about 90-100 μm and a central domed region 40 having a second substantially constant thickness of 30 μm (i.e. less than half the thickness of the first region 30). There is a step-wise cha'nge in thickness at the ring-shaped boundary 50 between the first peripheral ring-shaped region 30 and the second central domed region 40 (the ring-shaped boundary 50 being the location at which there is the transition between the first thickness and the second thickness). The ring-shaped boundary 50 has a diameter of 23.8 mm as compared to the outer diameter of the diaphragm 14 of 26.4 mm.

Figure 5:
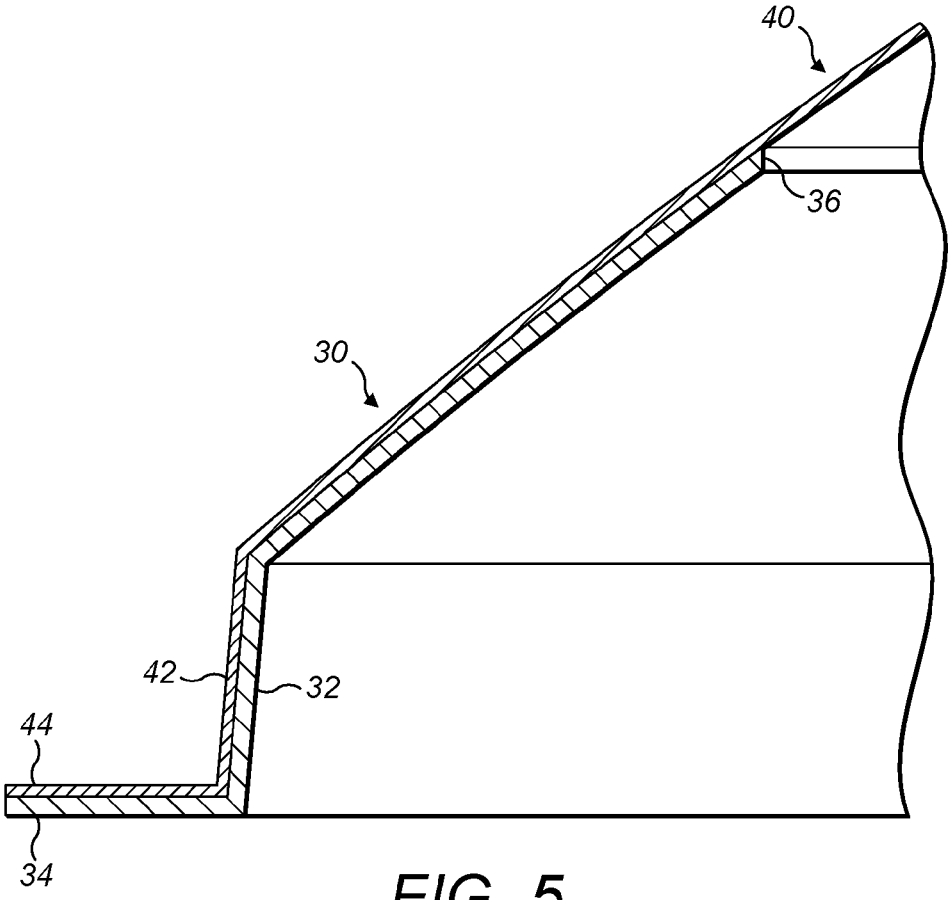
FIG. 5 is an enlarged cross-sectional view of a portion of the diaphragm of the first embodiment of the invention corresponding to a portion of FIG. 4.

FIG. 5 shows in further detail, and as an enlarged view, the portion of the cross-section of FIG. 4 indicated with the circle B. As can be seen from FIG. 5, the two regions 30, 40 of different thickness are formed by two separate parts each of substantially constant thickness. Thus, there is a first part 32 which has the general shape of a ring (or more precisely a truncated dome-shaped member) which is glued to a second, dome-shaped, part 42. The first part 32 is formed by punching a hole out from a circular disc and then forming the part on a suitably shaped forming member (using a punch and die-type arrangement). The second part 42 is similarly made from a circular disc formed on a suitably shaped forming member.

The adhesive used to glue the two parts 32, 42 together is selected to improve acoustic performance. The structure of the diaphragm of the present embodiment is such that it is desirable to reduce resonances at around 36 KHz. An adhesive that provides good damping effects at this frequency is therefore chosen. The damping properties of the adhesive polymer can be defined by the mechanical loss factor, which can be measured by means of a DMTA (dynamic mechanical thermal analysis) test. In the present embodiment, the adhesive is a PVAc glue, namely that sold under the name "Cascorez A452", which has a loss factor of about 0.6 at 35 KHz at 25 degrees Celsius. The loss factor of a polymer (and also its Young's modulus) is frequency and temperature dependent, so it is important to measure this property at the frequency and temperature at which the damping effects of the polymer are beneficial (around 36 KHz and room temperature in this case). It will be understood that when choosing a particular adhesive consideration should be given to achieving a relatively high loss factor around the first break-up frequency of the tweeter structure, at the normal operating temperature.

Before the adhesive is applied, the dome part 42 is held in place upside down and a bead of glue is evenly applied to the periphery of the dome part 42 with a glue dispensing machine. In this embodiment about 8 mg of adhesive is applied. The ring-shaped part 32 is brought into contact with the adhesive on the dome part 42, and the parts 32, 42 are gently urged together, until some of the adhesive is squeezed out (indicating that both parts are sufficiently in contact for an effective joint to be made). The excess adhesive is then wiped away. The layer of adhesive between the two parts has a thickness of about 20 μm. The adhesive layer provides enhanced mechanical damping of the diaphragm structure by effectively creating a constrained-layer damping system. This enables a decrease in the mechanical Q of some of the resonances.

The first part has a flange 34 and the second part has a corresponding flange 44. Both parts are formed from Aluminium. The two flanges 34, 44 are glued to each other, as a result of the above-mentioned gluing process, and provide a surface that facilitates mounting of the diaphragm relative to a mounting block via a suspension mounting. The same surface may also facilitate connection to a voice-coil assembly.

The first part 32 has a thickness of 50 μm and a mass of 35 mg and the second part 42 has a thickness of 30 μm and a mass of 54 mg, resulting in a total diaphragm mass of about 90 mg (excepting the mass of the adhesive). A conventional design of diaphragm of the same shape, size and material might have a uniform thickness of 50 μm and therefore roughly the same mass. By having a thicker, and therefore stiffer, peripheral region and a thinner central dome region, the mass of the diaphragm may be kept low whilst improving stiffness in the region where stiffness is most beneficial. As a result sensitivity may be maintained whilst improving (increasing) the break-up frequency. There is a steep slope 36 on the innermost diameter of the first part 32 which means that the change in thickness, as measured with increasing distance along the external surface of the diaphragm from the periphery to the centre, from the first region 30 to the second region 40 occurs within much less than 1% of the diameter of the diaphragm.

Figure 6:
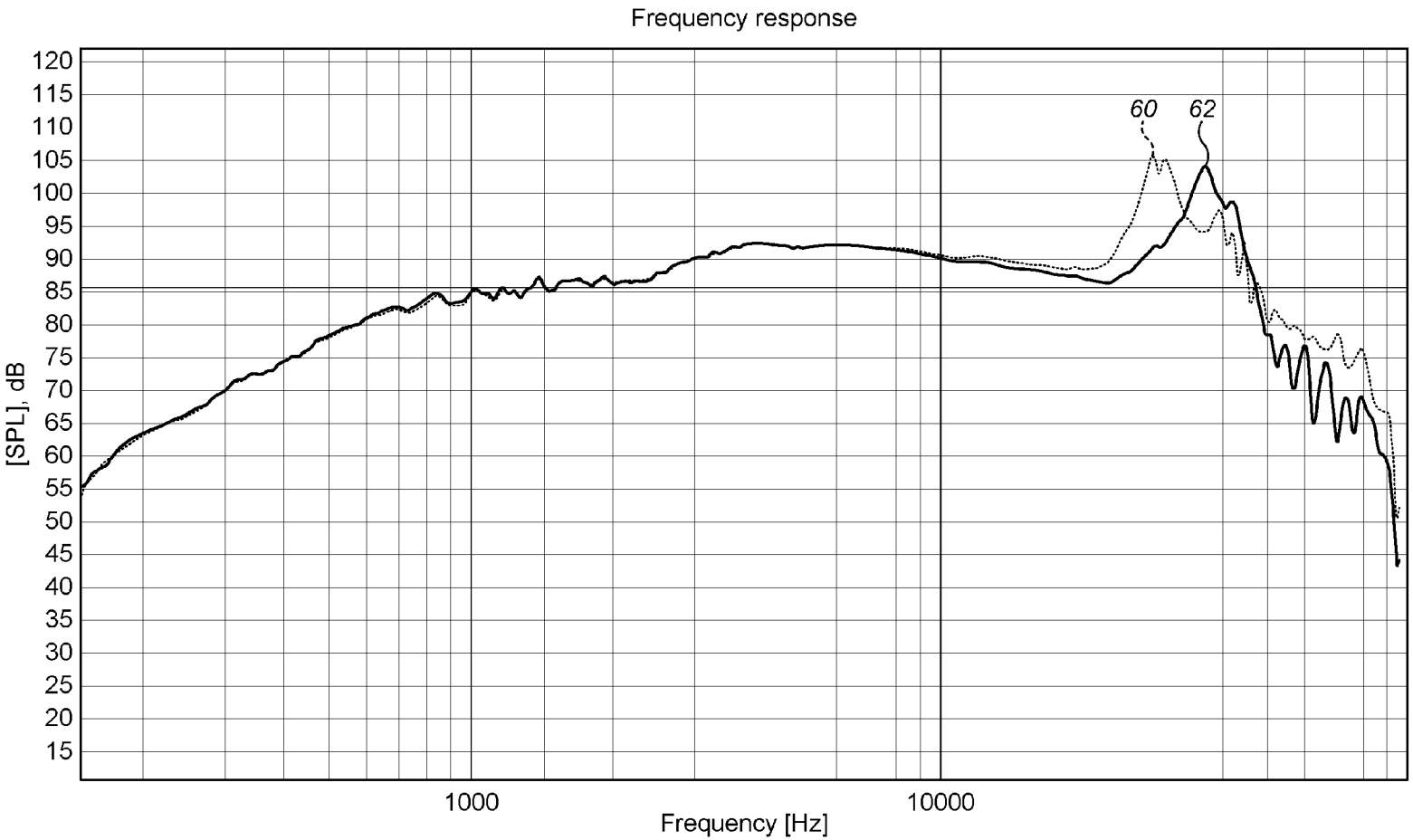
FIG. 6 is a graph of break-up frequency plotted against skirt depth.

FIG. 6 shows the acoustic response of a tweeter loudspeaker drive unit in which the diaphragm of the first embodiment of the invention is installed as compared to a tweeter loudspeaker drive unit in which a control diaphragm is installed. The control diaphragm is also made from aluminium, but is of one piece construction with a constant thickness of 50 μm and a mass of 90 mg. It has a shape and form otherwise very similar to the diaphragm of the first embodiment of the invention. The acoustic response graph shown in FIG. 6 shows the on-axis acoustic response, at 1 meter with a 2.84V RMs input voltage driving the speaker, in each case, with the y-axis of the graph showing the acoustic response as measured and the x-axis the frequency of the input drive signal. The response exhibited by the control diaphragm is shown in the light grey line 60 and the response exhibited by the diaphragm of the first embodiment of the invention is shown in the black line 62.

To a first approximation, one can consider the frequency response of a tweeter to be relatively flat until the first break-up frequency, that is, the frequency at which the tweeter stops moving as a rigid piston, that is, with all points on the surface moving with the same phase. At the break-up frequency, a peak occurs in the frequency response and the peak can be large for materials with low damping (which usually happen also to be desirable, stiff materials). Beyond the first break-up frequency a series of peaks and dips are apparent in the frequency response. Though resonance peaks in the frequency response in stiff, low damped materials are usually of high Q and are centred on a well defined frequency, the leading edge of the resonance can 'reach down' by two or more octaves below the resonant peak. Thus, for instance, a break-up frequency occurring at 30 kHz, can result in performance degradation at 7.5 kHz and below. For this reason it is desirable to have break-up frequencies as high as possible. A second reason for having the first break-up frequency as high as possible, and thus a flat response to as high a frequency as possible, arises from the advent of audio formats with bandwidths beyond the 22 kHz of the ordinary compact disc, effectively up to 192 kHz. If large peaks occur in the frequency response, the inherent non-linearity of the tweeter (arising from primarily the motor system and suspension) will be greatly increased, owing to the relatively high voice-coil displacement, and thus signals with more than one frequency component will provoke inter-modulation distortion, which will result in spurious signals at many frequencies, including the directly audible, sub 20 kHz range.

The commonly accepted upper frequency limit for human hearing is approximately 20 kHz but it is desirable that tweeter drive units have a frequency response that extends, and is relatively smooth and flat, well beyond this limit.

As can be seen from FIG. 6, the main dome breakup can be identified as the first peak in the response: 29 kHz for the control diaphragm and 37 kHz for the diaphragm of the first embodiment. It will be observed that the two responses overlay at lower frequencies, showing that the sensitivity of the two designs, both having the same mass, are substantially the same as each other at lower frequencies. Thus the diaphragm of the embodiment has an improved acoustic response with a higher breakup frequency than a diaphragm of same mass not incorporating the features of the diaphragm of the first embodiment. It is also believed that the adhesive layer provides improved mechanical damping properties, which results in the overall level being lower above 50 kHz for this design, as compared to the tweeter unit in which the control diaphragm is installed, as shown on the acoustic plot of FIG. 6.

In a second embodiment, not separately illustrated, the first part is made from Aluminium and the second part is made from Magnesium. The diaphragm is otherwise substantially identical to that of the first embodiment.

In a third embodiment, the diaphragm is of one-piece construction and formed by means of etching away an inner circular region from a circular disc of Aluminium of 75 μm thickness, the inner circular region having a diameter of about 90% that of the diameter of the disc. About 50 μm is etched away leaving an inner circular region having a thickness of about 25 μm. The etching could be via laser etching, or chemical etching (for example by means of a suitable acid). The disc is then formed into the desired shape by means of forming the disc on a suitably shaped forming member. The diaphragm is then coated with a synthetic diamond layer to provide enhanced stiffness. The diaphragm is otherwise substantially identical to that of the first embodiment.

Whilst the present invention has been described and illustrated with reference to particular embodiments, it will be appreciated by those of ordinary skill in the art that the invention lends itself to many different variations not specifically illustrated herein. By way of example only, certain possible variations will now be described.

Different thicknesses and dimensions of dome-shaped member could be utilised. There may be more than one step-wise change in thickness. There may be more than two regions of different thicknesses. Different materials for the diaphragm may be used. A different glue may be used to join the two parts of the diaphragm together when the diaphragm is made by gluing a ring-shaped member to the periphery of a dome-shaped member. One such example glue is Loctite's Instant CA 382 (a Cyanoacrylate adhesive). Manufacturing methods other than those described could be utilised to produce a diaphragm having the advantages and benefits of the diaphragm of the first embodiment. A microphone could readily be made using a diaphragm as illustrated herein.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

The invention claimed is:

1. A diaphragm for a tweeter loudspeaker drive unit, the diaphragm comprising a rigid dome-shaped member comprising a first, ring-shaped part and a second, dome-shaped part, the first and second parts being joined to each other by an adhesive layer which, together with the first and second parts, form a constrained layer damping system, there being a step-wise change in thickness of the dome-shaped member in the region of the innermost boundary of the first part such that the dome-shaped member has a thickness that varies from a first thickness at a first location at a periphery of the dome-shaped member and located outwardly away from the step-wise change in thickness to a second thickness at a second location, which is located inwardly of the step-wise change in thickness and thus nearer to the center of the dome-shaped member than the first location, wherein the first thickness is more than twice the second thickness, and the mechanical loss factor at 35 KHz of the adhesive is at least 0.5, and the step-wise change in thickness, when viewed in cross-section across a center of the diaphragm, is centered at a location which is between 5% and 25% of a distance measured from the periphery of the dome-shaped member along an external surface of the dome-shaped member to the center of the diaphragm.

2. A diaphragm according to claim 1, wherein the step-wise change in thickness, when viewed in cross-section across the center of the diaphragm, is localised within a distance of 1% of the width of the diaphragm.

3. A diaphragm according to claim 1, wherein the maximum thickness of the dome-shaped member is less than 0.1 mm and the minimum thickness of the dome-shaped member is less than 50 μm.

4. A diaphragm according to claim 1, wherein at least 90%, by area, of the thickness of the dome-shaped member has a thickness that is substantially the same as one of five fixed thicknesses.

5. A diaphragm according to claim 1, wherein the first and second parts are made from different materials.

6. A diaphragm according to claim 1, wherein the first and second parts are made from the same material.

7. A diaphragm according to claim 1, wherein the adhesive layer has a thickness of at least 10 μm.

8. A method of manufacturing a diaphragm for a tweeter loudspeaker drive unit, wherein the method comprises the steps of:

providing a first part in the shape of a truncated dome-shaped member providing a second, dome-shaped, part, joining the first part and the second part to each other with an adhesive layer formed by an adhesive with a mechanical loss factor of at least 0.5 at 35 KHz, the first part, the second part and the adhesive layer forming a rigid dome-shaped member having a constrained layer damping system, the rigid dome-shaped member having a peripheral region of greater thickness than a central region, and wherein, a change in thickness between the peripheral region and the central region is step-wise when viewed in cross-section across a center of the diaphragm, and is centered at a location which is between 5% and 25% of a distance measured from a periphery of the rigid dome-shaped member along an external surface of the rigid dome-shaped member to the center of the diaphragm.

9. A tweeter loudspeaker drive unit including a diaphragm as claimed in claim 1.

10. A tweeter loudspeaker drive unit comprising:

a mounting;

a diaphragm as claimed in claim 1, the diaphragm being mounted for movement relative to the mounting; and a voice coil and magnet assembly arranged to cause movement of the diaphragm relative to the mounting in response to an electronic signal.

11. A loudspeaker enclosure including a tweeter loudspeaker drive unit according to claim 10.

12. A diaphragm according to claim 1, wherein the rigid dome-shaped member has a diameter and the step-wise change in thickness has a diameter which is between 85% and 95% of the diameter of the dome-shaped member.

* * * * *